US005528782A

United States Patent [19]

Pfeuffer et al.

[11] Patent Number: 5,528,782

[45] Date of Patent: Jun. 25, 1996

[54] SUPPORT COLUMN FOR HOLDING A PATIENT SUPPORT MEANS

[75] Inventors: Reinhard Pfeuffer, Elchesheim-Ilingen; Klaus Bock, Kuppenheim, both of Germany

[73] Assignee: Stierlen-Maquet AG, Rastatt, Germany

[21] Appl. No.: 495,939

[22] Filed: Jun. 28, 1995

[30] Foreign Application Priority Data

Jul. 4, 1994 [DE] Germany ..... 44 23 402.3

[51] Int. Cl.[6] ..... A61G 13/00; A47B 9/00

[52] U.S. Cl. ..... 5/611; 5/607; 5/608; 108/6; 108/147; 248/396; 248/398; 297/330

[58] Field of Search ..... 5/607, 608, 610, 5/611; 254/2 B, 2 C, 2 R, 89 H, 93 R; 108/4, 6, 7, 8, 10, 147, 150; 297/330, 334.19, 334.2; 248/371, 396, 398, 584

[56] References Cited

U.S. PATENT DOCUMENTS

| | | | |
|---|---|---|---|
| 3,206,188 | 9/1965 | Douglass, Jr. | 5/607 |
| 3,940,771 | 2/1976 | Wild | 248/396 |
| 5,340,111 | 8/1994 | Froelich | 108/7 |

FOREIGN PATENT DOCUMENTS

| | | | |
|---|---|---|---|
| 1216141 | 3/1986 | U.S.S.R. | 254/93 |

*Primary Examiner*—Steven N. Meyers
*Assistant Examiner*—Robert G. Santos

[57] ABSTRACT

A support column for holding a patient support means of an operating table has a foot portion (18) and a head portion (46), which head portion is adapted for connection with the patient support means and by means of an adjusting mechanism located inside of the support column is adjustable relative to the foot portion (18) and pivotal about horizontal axes. The adjusting mechanism includes a lifting column standing on the foot portion (18), which lifting column at its upper end is connected with a lifting mount (30,32,34) carrying a number of linear drives (36) arranged parallel to the lifting column (20). Each linear drive at one of its ends is cardanically connected to the lifting mount (30,32,34) and at its other end is cardanically connected to the head portion (46), with the head portion (46) through at least one other cardanic joint (48) being connected with the lifting mount (30,32,34). The lifting column (20) is made to be nonrotatable, and it and the three linear drives (36) are—in plan view—arranged at least nearly at the corners of a rectangle, the head portion (46) being connected through a further cardanic joint (48), located nearly at the intersection point of the diagonals of the rectangle with a guide element (50), vertically adjustably but nonrotatably guided on the lifting mount (30,32,34).

5 Claims, 3 Drawing Sheets

SUPPORT COLUMN FOR HOLDING A PATIENT SUPPORT MEANS

FIELD OF THE INVENTION

The invention concerns improvements in a support column for holding a patient support means of an operating table, the column having a foot portion and a head portion with the head portion being adapted for connection with the patient support means and being capable of being adjusted in height relative to the foot portion and pivotal about horizontal axes by means of an adjusting mechanism located in the column, the adjusting mechanism including a lifting column standing on the foot portion and the upper end of which lifting column is connected with a lifting mount, the support column having a number of linear drives arranged parallel to the lifting column each of which linear drives is cardanically connected at one of its ends with the lifting mount and at its other end is cardanically connected to the head portion, the head portion being connected with the lifting mount through at least one further cardan joint.

BACKGROUND OF THE INVENTION

One such support column is for example known from DE-A-22 60 140. In this known approach the mount is made of a rectangular frame with two vertical side portions and a lower plate and an upper plate. This frame is vertically adjustably guided along both of its vertical side portions in a rigid guide connected with the column foot.

The lower plate carries two linear drives. The upper plate is connected with the head portion by a rigid rod and a cardan joint. This support column requires much space. Because of the rigid frame the minimum height to which the head portion, and with it the patient support means, can be lowered is relatively high.

The invention has as its object to so make a support column of the known type that it has a small space requirement, especially so that it has a small diameter, and so that the adjustable range of the head portion is larger, particularly in that the head portion and with it the patient support means can be lowered to a greater degree.

SUMMARY OF THE INVENTION

The inventive solution to the problem resides in that the lifting column is nonrotatable and in that it and three linear drives—as seen in plan view—are arranged at least nearly at the corners of a rectangle and in that the head portion is connected with a guide element through the further cardan joint nearly at the intersection point of the diagonals of the rectangle, which guide element is vertically adjustably but nonrotatably guided on the lifting mount.

With this solution of the invention a rigid frame and with it the great amount of space it requires is avoided. The described arrangement of the linear drives takes care of permitting a small space requirement for the column, yet a movability of the linear drives about their associated pivot axes is assured even in the entirely lowered condition of the head portion. Because of the forgoing of a rigid frame the adjustment range of the linear drives can be better utilized and thereby the head portion can be lowered farther than in the case of the known solution. Nevertheless, through the guide element security against a turning of the head portion relative to the column foot is assured.

A great space saving and material saving embodiment of the lifting mount is further provided in accordance with the invention in that the lifting mount has a hollow middle column for receiving the guide element, which middle column at its upper end is connected with the upper end of the lifting column through a radial arm and at its lower end is connected with a three armed carrier with the linear drives being hingedly connected respectively to the arms at points close to the free ends of the arms.

The lifting column and/or the linear drives can in a known way be formed as electro-mechanical spindle drives or as hydraulic drives.

In order on one hand to satisfy hygienic demands and on the other hand to protect the mechanism inside of the support column from contamination, the adjusting mechanism is surrounded by a telescopic housing which at its upper end is connected with the head portion through a bellows.

Further features and advantages of the invention will be apparent from the following description, which in connection with the accompanying drawings explains the invention through an exemplary embodiment.

DETAILED DESCRIPTION OF THE PREFERRED EMBODIMENT

Figure 1:
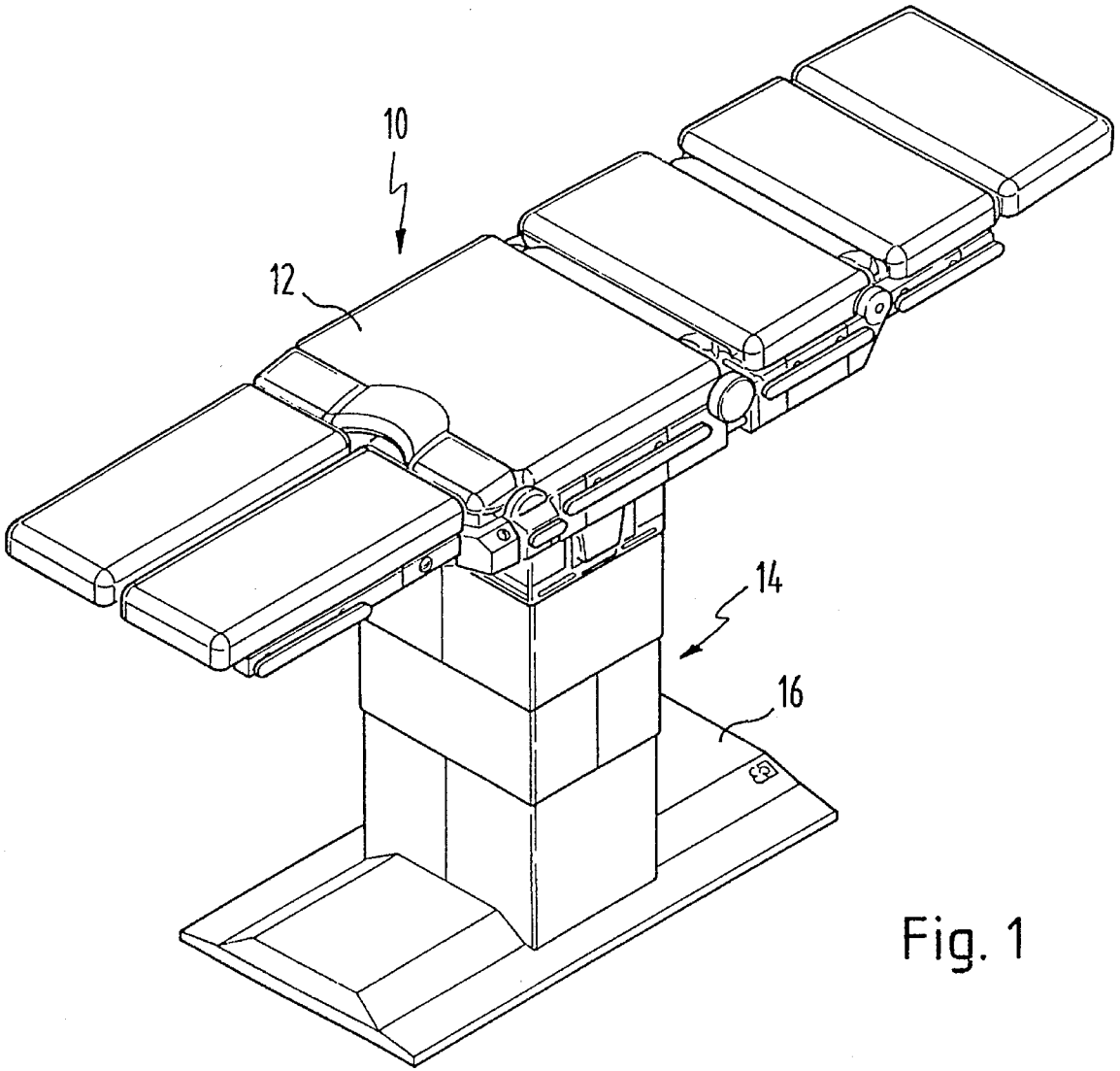
FIG. 1—a schematic perspective illustration of an operating table embodying the invention, FIG. 2—a perspective partially schematic illustration of the interior of the column and of the adjusting device, and FIG. 3—a schematic plan view of the foot portion of the column.

The operating table illustrated in FIG. 1 includes a patient support means designated generally at 10 and a support column indicated generally at 14 connected with a middle section 12 of the patient support means and having a column foot 16.

Figure 2:
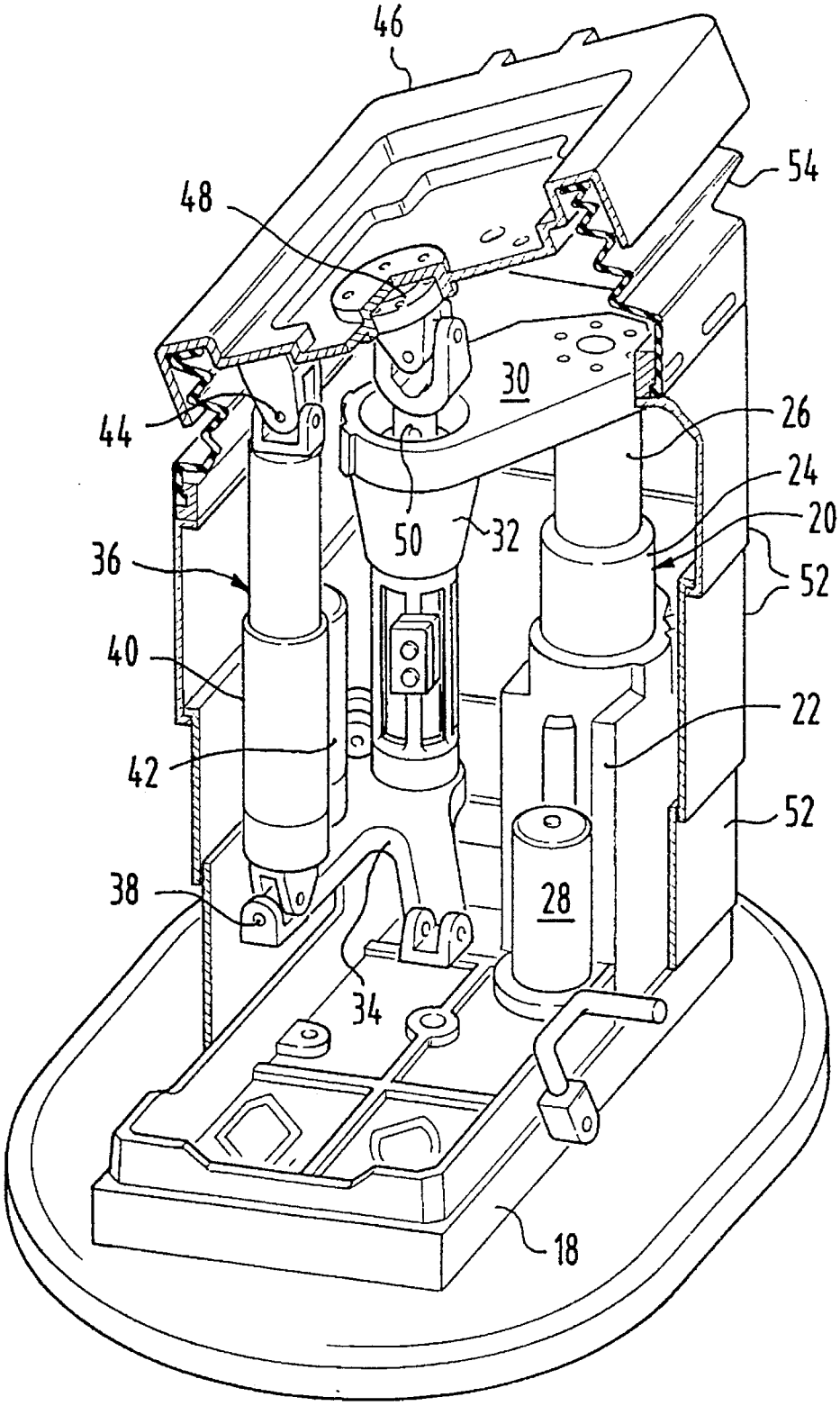

As seen in FIG. 2 the support column 14 includes a foot portion 18 which is built into either the column foot illustrated in FIG. 1 or directly into the floor of an operating room. On the foot portion 18 stands a doubly telescopic lifting column 20 connected with the foot portion 18 and having a base portion 22 fastened to the foot portion 18 and two telescope tubes 24 and 26. The lifting column 20 is in a way known in itself formed as a spindle drive with the spindle being driven by a low voltage electric motor 28 arranged on the base portion 22. A nonillustrated pinion is received on the drive shaft of the electric motor 28 and through a chain drives a chain wheel received on a threaded spindle rotatably supported inside of the lifting column 20. This threaded spindle drives, as a result of its rotation, the tubes 24 and 26 through a threaded socket connected to the tube 26.

Figure 3:
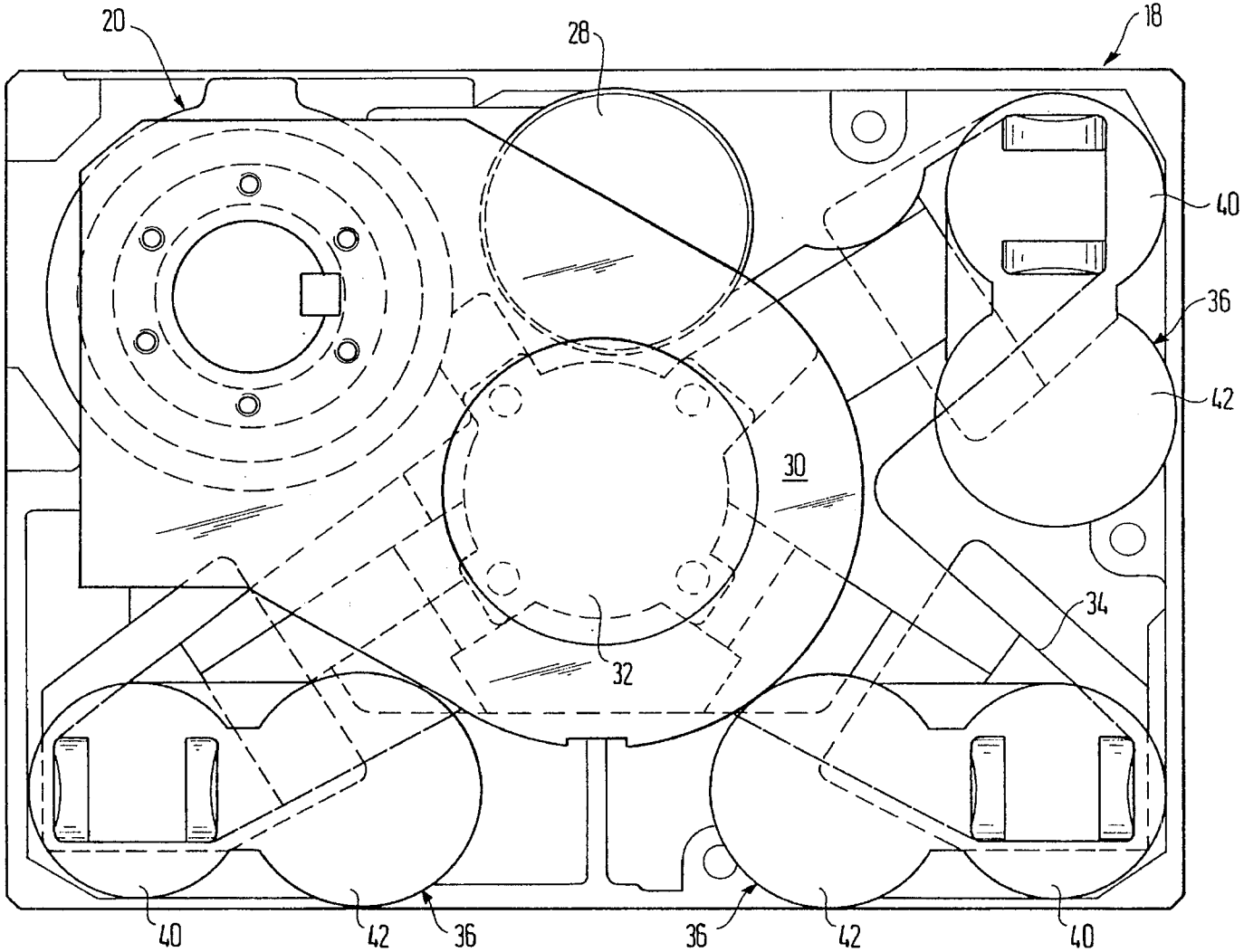

A radial arm 30 is connected with the upper end of the telescope tube 26, which arm on its free end carries a downwardly extending guide or middle column 32. The lower end of the guide column 32 is rigidly connected with a three armed carrier 34. One linear drive 36 is arranged at the free end of each of the three arms of the carrier 34, which linear drive at its lower end is connected with the free end of the associated carrier arm through a two axis cardan joint 38. As shown by FIG. 3 the arms of the carrier 34 are so formed that the three linear drives 36 and the lifting column 20—as seen in plan view—are arranged at the four corners of the rectangular plate shaped foot portion.

Each linear drive includes, in a way known in itself, a telescope column 40 receiving a spindle drive and a low voltage electric motor 42, which in the same way as described for the lifting column 20, drives the spindle inside of the telescope column 40 through a chain drive.

The upper end of each telescope column 40 is connected through a two axis cardan joint 44 to a plate shaped head portion 46 of the support column 14. A rod shaped guide element 50 is connected to the head portion 46 at a middle point between the cardan joints 44 through a further cardan joint 48, which guide element 50 is nonrotatably but vertically slidably guided in the hollow guide tube 32.

The adjusting mechanism of the support column 14 made up of the lifting column and the three linear drives is surrounded by a housing made of three covering rings 52 which telescopically overlap so that they can slide relative to one another and thereby assure a complete covering of the inside space of the column despite the adjustability of the head portion 46. The head portion 46 is connected with the uppermost covering ring 52 through a bellows 54.

As can be understood from the foregoing description, the head portion 46 can be adjusted in height through the lifting column 20. By means of the linear drives 36 the inclination of the head portion 46 can be set in a desired direction and about desired axes. The guide element 50 assures that the head portion 46 is held stable and nonrotatable despite the movable support of the linear drives 36.

The lifting column according to the invention is in its construction extremely compact and has thereby a small diameter. Nevertheless, it is possible to move the column to a low heighth, that is to lower the head portion and the patient support means on the head portion to a low level, without this on the other hand being hindered by the linear drives. This is important since the linear drives incline at least slightly from their vertical positions upon inclination of the head portion 46.

We claim:

1. A support column for holding a patient support means (10) of an operating table with a foot portion (18), a housing (52), and a head portion (46), which support column is suited for connection with the patient support means (10) and adjustable in height relative to the foot portion (18) by means of an adjusting mechanism inside of the housing (52) and which can be pivoted about horizontal axes, the adjusting mechanism including a lifting column (20) standing on the foot portion (18), the upper end of which lifting column is connected with a lifting mount (30,32,34) having a number of linear drives (36) arranged parallel to the lifting column (20), each of which linear drives is cardanically connected to the lifting mount (30,32,34) at one of its ends and at its other end is cardanically connected with the head portion (46), the head portion (46) being connected with the lifting mount (30,32,34) through at least one further cardan joint (48), characterized in that said adjusting mechanism includes three linear drives (36), in that the lifting column (20) is nonrotatable, in that the lifting column (20) and said three linear drives (36) are arranged—as seen in plan view—at position corresponding at least approximately to the corners of a rectangle, and in that the head portion (46) is connected with a guide element (50) through the further cardan joint (48) which is located nearly at the intersection point of the diagonals of the rectangle, which guide element is adjustably but nonrotatably guided on the lifting mount (30,32,34).

2. A support column according to claim 1, characterized in that the lifting mount (30,32,34) has a hollow middle column (32) receiving the guide element (50), which middle column (32) has a radial arm (30) at its upper end connected with the upper end of the lifting column (20) and at its lower end is connected with a three armed carrier (34), said linear drives (36) being pivotally connected to said arms near the free ends of said arms.

3. A support column according to claim 1 characterized in that at/.east one of the components of the group consisting of said lifting column (20) and said three linear drives (36) is made as an electro-mechanical spindle drive.

4. A support column according to claim 1 further characterized in that at least one of said components consisting of said lifting column (20) and said three linear drives (36) is made as an hydraulic drive.

5. A support column according to claim 1 characterized in that the adjusting mechanism is surrounded by a telescopic housing (52) which at its upper end is connected with the head portion (46) through a bellows (54).

* * * * *